US009483013B2

(12) United States Patent
Adachi

(10) Patent No.: US 9,483,013 B2
(45) Date of Patent: Nov. 1, 2016

(54) IMAGE FORMING APPARATUS HAVING IMAGE BEARING MEMBERS

(71) Applicant: Brother Kogyo Kabushiki Kaisha, Nagoya-shi, Aichi-ken (JP)

(72) Inventor: Aya Adachi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/327,879

(22) Filed: Jul. 10, 2014

(65) Prior Publication Data

US 2015/0016855 A1 Jan. 15, 2015

(30) Foreign Application Priority Data

Jul. 12, 2013 (JP) ..... 2013-146324

(51) Int. Cl.
*G03G 21/00* (2006.01)
*G03G 15/01* (2006.01)

(52) U.S. Cl.
CPC ..... *G03G 21/0035* (2013.01); *G03G 15/0194* (2013.01)

(58) Field of Classification Search
CPC ..... G03G 2221/0026; G03G 2221/0042; G03G 2221/0068; G03G 2221/1627; G03G 2221/1815; G03G 21/0035; G03G 21/0058; G03G 21/006; G03G 21/007; G03G 21/0076; G03G 21/1828
See application file for complete search history.

(56) References Cited

U.S. PATENT DOCUMENTS 4,021,113 A * 5/1977 Zindikus ..... G03G 21/0041 15/256.52
7,221,890 B2 5/2007 Nishimura
2002/0176716 A1* 11/2002 Yokoi ..... G03G 15/1675 399/21
2003/0039495 A1* 2/2003 Takami ..... G03G 21/0058 399/357
2005/0100364 A1 5/2005 Nishimura
2007/0292178 A1* 12/2007 Iwasaki ..... G03G 21/0058 399/357
2009/0010693 A1* 1/2009 Hatori ..... G03G 21/1814 399/346
2011/0182615 A1* 7/2011 Morishita ..... G03G 21/1842 399/111

FOREIGN PATENT DOCUMENTS

JP 2005-114756 A 4/2005
JP 2006-126591 A 5/2006
JP 2012-247479 A 12/2012

* cited by examiner

*Primary Examiner* — Minh Phan
*Assistant Examiner* — Victor Verbitsky
(74) *Attorney, Agent, or Firm* — Banner & Witcoff, Ltd.

(57) ABSTRACT

An image forming apparatus includes: a first image forming unit including a first image bearing member and a first rotating member configured to rub a surface of the first image bearing member; a second image forming unit including a second image bearing member and a second rotating member configured to rub a surface of the second image bearing member; and a transfer unit configured to convey a sheet between the first image bearing member and the second image bearing member and transfer a developer on the first image bearing member and the second image bearing member, onto the sheet. The first image forming unit is disposed upstream of the second image forming unit in a sheet conveying direction. A force of the second rotating member rubbing the surface of the second image bearing member is less than a force of the first rotating member rubbing the surface of the first image bearing member.

7 Claims, 7 Drawing Sheets

IMAGE FORMING APPARATUS HAVING IMAGE BEARING MEMBERS

CROSS REFERENCE TO RELATED APPLICATION

The present application claims priority from Japanese Patent Application No. 2013-146324, which was filed on Jul. 12, 2013, the disclosure of which is herein incorporated by reference in its entirety.

BACKGROUND

1. Technical Field

The present invention relates to an image forming apparatus including a rotating member for rubbing a surface of an image bearing member.

2. Description of the Related Art

There is known a direct tandem image forming apparatus including a plurality of photoconductive drums. This image forming apparatus includes cleaning members capable of contacting the respective photoconductive drums. Each of the cleaning members rubs a surface of a corresponding rotating one of the photoconductive drums to remove foreign matters, e.g., paper dust from the photoconductive drum.

SUMMARY

Incidentally, foreign matters, e.g., paper dust are easily attached to a photoconductive drum located on the most upstream side in a sheet conveying direction at a position near an opening for loading of a sheet. Thus, a force of the cleaning member rubbing the photoconductive drum is preferably made large. However, if forces of all the cleaning members rubbing the respective photoconductive drums are made large, unnecessary loads are applied to the respective photoconductive drums other than the most upstream photoconductive drum. This may inhibit smooth rotation of the photoconductive drums, leading to a printing failure such as banding.

This invention has been developed to provide an image forming apparatus enabling better removal of foreign matters from a surface of an upstream photoconductive drum in a sheet conveying direction and smooth rotation of a downstream photoconductive drum.

The present invention provides an image forming apparatus including: a first image forming unit including a first image bearing member and a first rotating member configured to rub a surface of the first image bearing member; a second image forming unit including a second image bearing member and a second rotating member configured to rub a surface of the second image bearing member; and a transfer unit configured to convey a recording sheet between the first image bearing member and the second image bearing member and transfer a developer on the first image bearing member and the second image bearing member, onto the recording sheet. The first image forming unit is disposed upstream of the second image forming unit in a direction in which the recording sheet is conveyed. A force of the second rotating member rubbing the surface of the second image bearing member is less than a force of the first rotating member rubbing the surface of the first image bearing member.

BRIEF DESCRIPTION OF THE DRAWINGS

The objects, features, advantages, and technical and industrial significance of the present invention will be better understood by reading the following detailed description of the embodiment of the invention, when considered in connection with the accompanying drawings, in which.

DETAILED DESCRIPTION OF THE EMBODIMENT

Hereinafter, there will be described one embodiment of the present invention by reference to the drawings. In the following description, an overall structure of a color printer 1 as one example of an image forming apparatus will be explained first, and features of the present invention will be thereafter explained.

Figure 1:
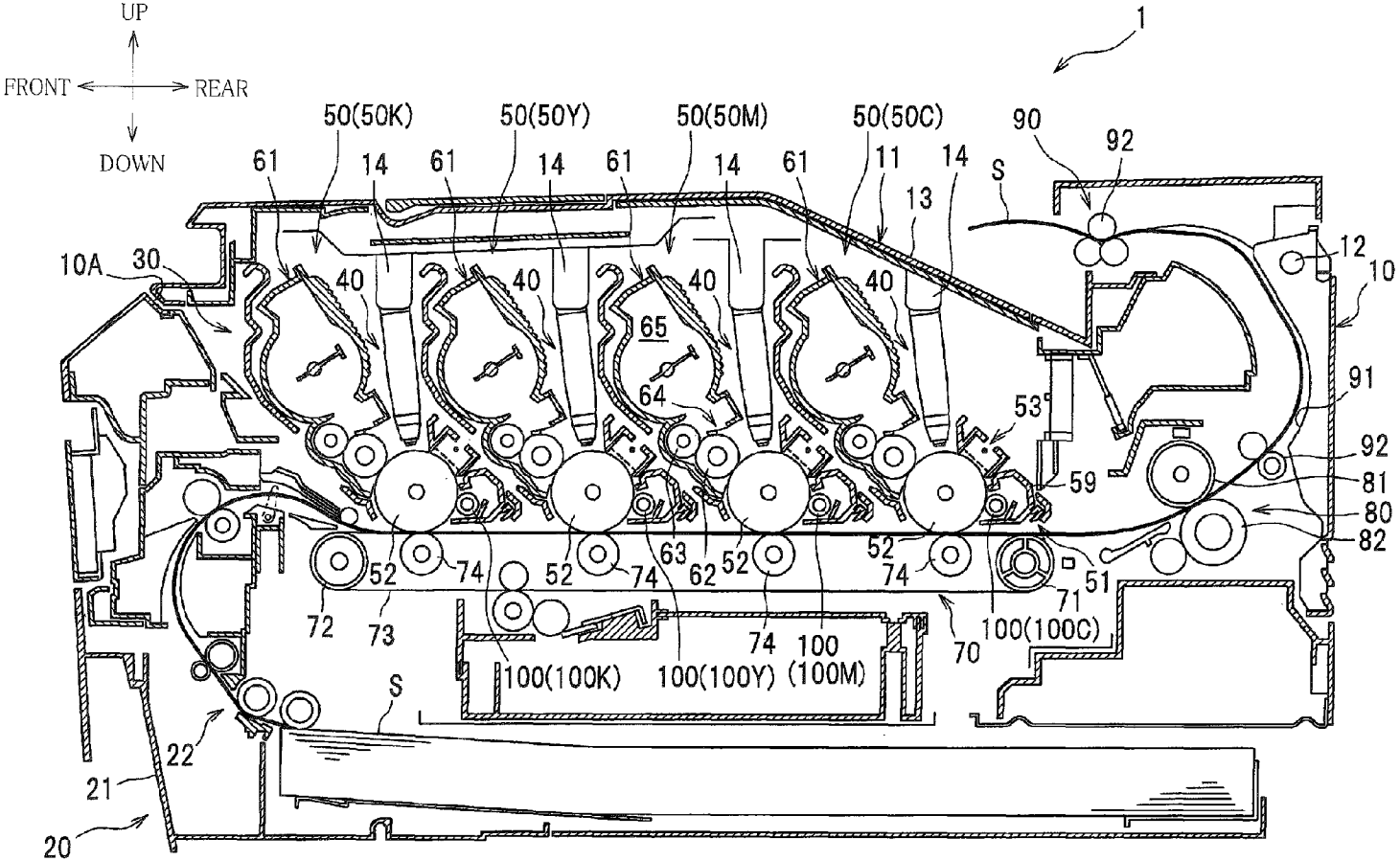
FIG. 1 is a cross-sectional view illustrating a color printer according to one embodiment of the present invention.

In the following description, directions are defined with respect to a user using this color printer 1. That is, a left side, a right side, a back side, and a front side in FIG. 1 are respectively defined as a front side, a rear side, a left side, and a right side. Also, an up and down direction in FIG. 1 are defined as an up and down direction.

<Overall Construction of Color Printer>

As illustrated in FIG. 1, the color printer 1 includes a body housing 10, an upper cover 11, a sheet-supply portion 20 for supplying a sheet S as one example of a recording sheet, an image forming portion 30 for forming an image on the supplied sheet S, and a sheet-output portion 90 for discharging the sheet S on which the image is formed.

The upper cover 11 is provided on an upper portion of the body housing 10 so as to pivot about a pivot shaft 12 located at a rear portion of the body housing 10 such that a front portion of the upper cover 11 moves upward and downward with respect to the body housing 10. This movement of the upper cover 11 opens and closes an opening 10A formed in an upper face of the body housing 10.

The sheet-supply portion 20 includes a sheet-supply tray 21, provided in a lower portion of the body housing 10, for storing sheets S, and a sheet-supply mechanism 22 for supplying the sheets S from the sheet-supply tray 21 to the image forming portion 30. The sheets P in the sheet-supply tray 21 are separated one by one by the sheet-supply mechanism 22 and supplied to the image forming portion 30.

The image forming portion 30 includes four LED units 40, four process units 50, a transfer unit 70, and a fixing unit 80.

Each of the LED units 40 is pivotably supported by the upper cover 11 via a holder 14 and disposed on an upper side of a corresponding one of photoconductive drums 52 in a state in which the upper cover 11 is closed. This LED unit 40 illuminates or exposes a surface of the electrically charged photoconductive drum 52 by blinking, based on image data, of a light emitting portion, i.e., an LED, provided at a distal end of the LED unit 40.

The process units 50 are arranged in parallel in the front and rear direction between the upper cover 11 and the sheet-supply tray 21 so as to be mountable on and removable from the body housing 10 substantially in the up and down direction through the opening 10A of the body housing 10 which is exposed when the upper cover 11 is open.

The process units 50 are constituted by process units 50K, 50Y, 50M, 50C respectively containing black toner, yellow toner, magenta toner, and cyan toner and arranged in this order from an upstream side in a sheet conveying direction (in which the sheet S is conveyed) that is directed from a front side to a rear side. In other words, the process unit 50K for black toner as one example of a first image forming unit is disposed upstream of the process unit 50C for cyan toner as one example of a second image forming unit in the sheet conveying direction, and the process unit 50Y for yellow toner as one example of a third image forming unit and the process unit 50M for magenta toner as one example of a fourth image forming unit are arranged between the process unit 50K and the process unit 50C, the process unit 50Y being disposed upstream of the process unit 50M. The process unit 50K for black toner is disposed near an opening which is formed in the image forming portion 30 for loading of the sheet S.

Each of the process units 50 includes a drum unit 51 and a developing unit 61 which is removably mounted on the drum unit 51.

The drum unit 51 includes a drum frame 59, the photoconductive drum 52 as one example of an image bearing member provided on the drum frame 59, a charging unit 53, and a cleaning roller 100 as one example of a rotating member. The cleaning roller 100 will be explained later. It is noted that rotational speeds of the photoconductive drums 52 of the respective process units 50 are set to be the same.

The developing unit 61 includes a developing roller 62, a supply roller 63, a layer-thickness limiting blade 64, and a toner container 65 for containing toner as one example of a developer which is positively charged.

Each of the developing rollers 62 is provided corresponding to one of the photoconductive drums 52 and bears toner on its surface. This developing roller 62 supplies toner onto the photoconductive drum 52 when the developing roller 62 contacts the photoconductive drum 52 in a state in which a positive developing bias is applied to the developing roller 62.

The transfer unit 70 is provided between the sheet-supply tray 21 and the process units 50 and includes a drive roller 71, a driven roller 72, an endless conveyor belt 73 looped over the drive roller 71 and the driven roller 72, and the four transfer rollers 74. An outer surface of the conveyor belt 73 is held in contact with the photoconductive drums 52, and the conveyor belt 73 conveys the sheet S between the process unit 50K and the process unit 50C. The transfer rollers 74 are arranged inside the conveyor belt 73 so as to be opposite the photoconductive drums 52, with the conveyor belt 73 interposed between the transfer rollers 74 and the photoconductive drums 52.

The fixing unit 80 is provided at a rear of the process units 50 and the transfer unit 70 and includes a heated roller 81 and a pressure roller 82 disposed so as to opposite the heated roller 81 to press the heated roller 81.

In the image forming portion 30, the surface of the photoconductive drum 52 is electrically charged uniformly by the charging unit 53, and then illuminated and exposed by the LED units 40, so that an electrostatic latent image based on image data is formed on the photoconductive drum 52.

The toner in the toner container 65 is supplied to the developing roller 62 via the supply roller 63 and then to a position between the developing roller 62 and the layer-thickness limiting blade 64 and borne on the developing roller 62 as a thin layer having a constant thickness. In this process, the toner is frictionally charged positively between the developing roller 62 and the supply roller 63 and between the developing roller 62 and the layer-thickness limiting blade 64.

The toner borne on the developing roller 62 is supplied to an exposed region of the photoconductive drum 52, which forms an visible image from the electrostatic latent image, that is, a toner image is formed on the photoconductive drum 52. The sheet S supplied from the sheet-supply portion 20 is thereafter conveyed through an area between the photoconductive drums 52 and the conveyor belt 73, whereby the toner images formed on the respective photoconductive drums 52 are transferred to the sheet S. The sheet S on which the toner images are transferred is conveyed through a position between the heated roller 81 and the pressure roller 82, whereby the toner images are fixed to the sheet S by heat.

The sheet-output portion 90 includes a sheet output passage 91 for guiding the sheet S conveyed from the fixing unit 80, and a plurality of conveying rollers 92 for conveying the sheet S. The sheet S on which the toner image is fixed by heat, i.e., the sheet P on which the image is formed is conveyed by the conveying rollers 92 through the sheet output passage 91, discharged to the outside of the body housing 10, and placed onto a sheet-output tray 13.

<Cleaning Rollers>

There will be next explained the cleaning rollers 100.

Figure 2:
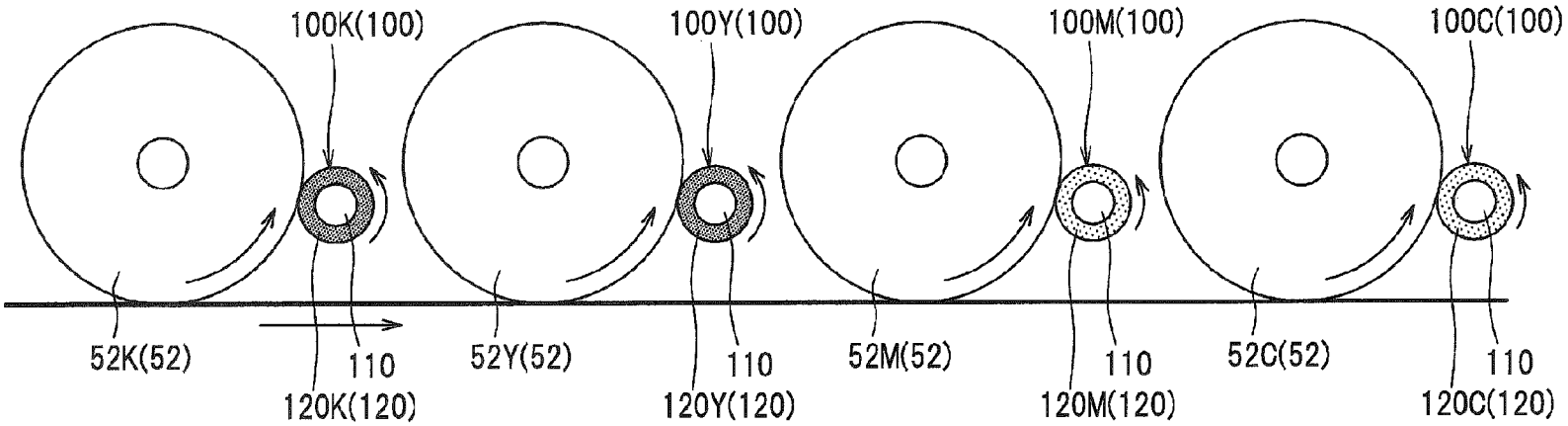
FIG. 2 is an enlarged view illustrating four photoconductive drums arranged in a sheet conveying direction and cleaning rollers respectively corresponding to the photoconductive drum.

As illustrated in FIG. 2, the cleaning rollers 100 are rotatably provided for the respective photoconductive drums 52. Each of the cleaning rollers 100 scrubs the surface of the corresponding photoconductive drum 52 to remove foreign matters (such as paper dust and toner) from the photoconductive drum 52. In use, the cleaning roller 100 and the photoconductive drum 52 are rotated in the same direction, but at an area of the cleaning roller 100 which contacts the photoconductive drum 52, the traveling direction of the cleaning roller 100 is reverse to the traveling direction of the photoconductive drum 52.

In the following description, the word "first" is affixed to the members corresponding to black as needed, the word "third" to the members corresponding to yellow, the word "fourth" to the members corresponding to magenta, and the word "second" to the members corresponding to cyan. Furthermore, each of the reference numerals for the components relating to the colors of toner such as the photoconductive drum 52 and the cleaning roller 100 may contain a corresponding one of the signs "K", "Y", "M", and "C" respectively representing black, yellow, magenta, and cyan.

Each of the cleaning rollers 100 is constituted by a roller shaft 110 having a circular cylindrical shape and a roller portion 120 formed of foam rubber and covering the roller shaft 110. In other words, the surface of the cleaning roller 100 which contacts the photoconductive drum 52 is formed of foam rubber. In the present embodiment, the roller shafts 110 of the respective cleaning rollers 100 have the same construction, and the photoconductive drums 52 also have the same construction. Also, the cleaning rollers 100 have the same outside diameter, and the roller shafts 110 and shafts of the respective photoconductive drum 52 are respectively spaced from each other at the same distance.

Specifically, the first roller portion 120K is formed of ethylene propylene rubber, and the second roller portion 120C is formed of silicon rubber. Because of these constructions, the hardness of the second cleaning roller 100C is less than that of the first cleaning roller 100K. Accordingly, in a case where the cleaning rollers 100 are in contact with the respective photoconductive drums 52 so as to be compressed by the same amount, the resilience of the second roller portion 120C is less than that of the first roller portion 120K. That is, a pressure at which the second cleaning roller 100C is in contact with the second photoconductive drum 52C is less than a pressure at which the first cleaning roller 100K is in contact with the first photoconductive drum 52K.

The third roller portion 120Y is formed of ethylene propylene rubber like the first roller portion 120K, and the fourth roller portion 120M is formed of silicon rubber like the second roller portion 120C. Accordingly, a pressure at which the third cleaning roller 100Y is in contact with the third photoconductive drum 52Y is equal to the pressure at which the first cleaning roller 100K is in contact with the first photoconductive drum 52K, and a pressure at which the fourth cleaning roller 100M is in contact with the fourth photoconductive drum 52M is equal to the pressure at which the second cleaning roller 100C is in contact with the second photoconductive drum 52C.

In the present embodiment, the rotational speed of the second cleaning roller 100C is set to be lower than the rotational speed of the first cleaning roller 100K. Accordingly, the difference in rotational speed between the second cleaning roller 100C and the second photoconductive drum 52C is smaller than the difference in rotational speed between the first cleaning roller 100K and the first photoconductive drum 52K.

The rotational speed of the third cleaning roller 100Y is set to be equal to that of the first cleaning roller 100K, and the rotational speed of the fourth cleaning roller 100M is set to be equal to that of the second cleaning roller 100C. Accordingly, a difference in rotational speed between the third cleaning roller 100Y and the third photoconductive drum 52Y is equal to the difference in rotational speed between the first cleaning roller 100K and the first photoconductive drum 52K, and a difference in rotational speed between the fourth cleaning roller 100M and the fourth photoconductive drum 52M is equal to the difference in rotational speed between the second cleaning roller 100C and the second photoconductive drum 52C.

To make the rotational speeds of the cleaning rollers 100 different from one another, gear ratios of gear trains for driving the respective cleaning rollers 100 are made different from one another, for example.

There will be next explained operations and effects of the color printer 1 including the cleaning rollers 100 having the constructions described above.

The cleaning rollers 100 are rotated in the same direction as the photoconductive drums 52 while scrubbing the surfaces of the respective photoconductive drums 52. Here, the cleaning roller 100 and the surface of the photoconductive drum 52 scrub each other at their respective contact portions, so that foreign matters (such as paper dust and toner) on the surface of the photoconductive drum 52 are removed by the cleaning roller 100.

Incidentally, foreign matters, e.g., paper dust are easily attached in particular to the first photoconductive drum 52K located near the opening for loading of the sheet S on the most upstream side in the sheet conveying direction among the photoconductive drums 52. Thus, a force of the first cleaning roller 100K rubbing the first photoconductive drum 52K is preferably made larger. In this case, if a force of the second cleaning roller 100C rubbing the second photoconductive drum 52C is also made large, an unnecessary load is applied to the second photoconductive drum 52C which is located on the most downstream side among the photoconductive drums 52 and to which foreign matters, e.g., paper dust are less attached when compared with the first photoconductive drum 52K. This unnecessary load inhibits smooth rotation of the second photoconductive drum 52C, leading to a printing failure such as banding.

In the present embodiment, however, the difference in rotational speed between the second cleaning roller 100C and the second photoconductive drum 52C is less than the difference in rotational speed between the first cleaning roller 100K and the first photoconductive drum 52K. Thus, a frictional force by which the second cleaning roller 100C scrubs the second photoconductive drum 52C is smaller than a frictional force by which the first cleaning roller 100K scrubs the first photoconductive drum 52K. That is, since the force of the second cleaning roller 100C rubbing the surface of the second photoconductive drum 52C is smaller than the force of the first cleaning roller 100K rubbing the surface of the first photoconductive drum 52K, a load applied from the second cleaning roller 100C to the second photoconductive drum 52C is smaller than a load applied from the first cleaning roller 100K to the first photoconductive drum 52K. Accordingly, foreign matters can be reliably removed from the surface of the first photoconductive drum 52K, and the second photoconductive drum 52C can be rotated smoothly.

It is noted that the above-described difference in rotational speed can be set as needed. While the cleaning roller 100 and the photoconductive drum 52 are rotated in the same direction in the present embodiment, in a case where the difference in rotational speed between the second cleaning roller 100C and the second photoconductive drum 52C is less than the difference in rotational speed between the first cleaning roller 100K and the first photoconductive drum 52K, at least one of the cleaning rollers 100 may be rotated in a direction reverse to the rotational direction of the photoconductive drum 52 (that is, the traveling direction of the cleaning rollers 100 coincides with the traveling direction of the photoconductive drum 52). Also, the rotational speed of each cleaning roller 100 may be set as needed as long as the above-described conditions are satisfied. For example, in a case where the rotational direction of the cleaning roller 100 and that of the photoconductive drum 52 are reverse to each other, the rotational speed of each cleaning roller 100 may be made greater than the rotational speed of the photoconductive drum 52.

The pressure at which the second cleaning roller 100C is in contact with the second photoconductive drum 52C is less than the pressure at which the first cleaning roller 100K is in contact with the first photoconductive drum 52K. Accordingly, the force of the second cleaning roller 100C rubbing the surface of the second photoconductive drum 52C is smaller than the force of the first cleaning roller 100K rubbing the surface of the first photoconductive drum 52K, enabling more smooth rotation of the second photoconductive drum 52C.

Incidentally, foreign matters, e.g., paper dust are attached to the third photoconductive drum 52Y located next to the most upstream first photoconductive drum 52K in the sheet conveying direction at the second highest frequency. Thus, a force of the third cleaning roller 100Y rubbing the third photoconductive drum 52Y is preferably set to be relatively large. In the present embodiment, the contact pressure and the rotational speed of the third cleaning roller 100Y are equal to those of the first cleaning roller 100K, so that the magnitude of the force of the third cleaning roller 100Y rubbing the third photoconductive drum 52Y is equal to that of the force of the first cleaning roller 100K rubbing the first photoconductive drum 52K. Accordingly, the third photoconductive drum 52Y can be rubbed by a force identical to the force by which the first photoconductive drum 52K is rubbed.

While the embodiment of the present invention has been described above, it is to be understood that the invention is not limited to the details of the illustrated embodiment, but may be embodied with various changes and modifications, which may occur to those skilled in the art, without departing from the spirit and scope of the invention.

In the above-described embodiment, the difference in rotational speed between the second cleaning roller 100C and the second photoconductive drum 52C is less than the difference in rotational speed between the first cleaning roller 100K and the first photoconductive drum 52K. However, these differences in rotational speed may be equal to each other as long as the force of the second cleaning roller 100C rubbing the second photoconductive drum 52C is smaller than the force of the first cleaning roller 100K rubbing the first photoconductive drum 52K.

While the material of the first roller portion 120K and that of the second roller portion 120C are different from each other in the above-described embodiment, these roller portions may be formed of the same material as long as the force of the second cleaning roller 100C rubbing the second photoconductive drum 52C is smaller than the force of the first cleaning roller 100K rubbing the first photoconductive drum 52K.

Figure 3:
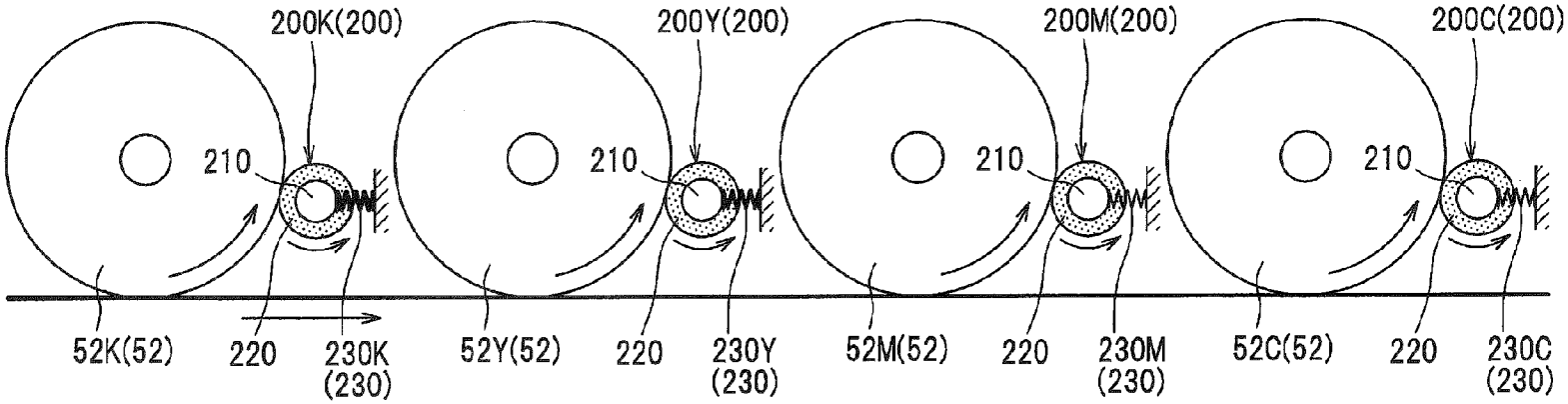
FIG. 3 is a view illustrating a first modification and corresponding to FIG. 2.

FIG. 3 illustrates one example of a configuration in which the cleaning rollers are rotated at the same speed, and the roller portions are formed of the same material. In FIG. 3, compression springs 230 having different urging forces are provided.

In this configuration, each of cleaning rollers 200 is constituted by a roller shaft 210 and a roller portion 220.

The compression springs 230 respectively urge components such as bearings of the cleaning rollers 200 to the photoconductive drums 52, and urging forces of the respective compression springs 230 are partly different from one another.

Specifically, the first compression spring 230K as one example of a first urging member has the largest urging force among the compression springs 230, with the third compression spring 230Y and the fourth compression spring 230M following in that order. The second compression spring 230C as one example of a second urging member has the same construction as the fourth compression spring 230M.

In this configuration, the first cleaning roller 200K has the highest contact pressure among the cleaning rollers 200, with the third cleaning roller 200Y and the fourth cleaning roller 200M following in that order. Also, the contact pressure of the second cleaning roller 200C is equal to that of the fourth cleaning roller 200M. It is noted that each of the third cleaning roller 200Y and the fourth cleaning roller 200M can be considered to as a second rotating member. The compression spring 230 is used as the urging member, but the present invention is not limited to this configuration, and the compression spring 230 may be a torsion spring, for example.

Figure 4:
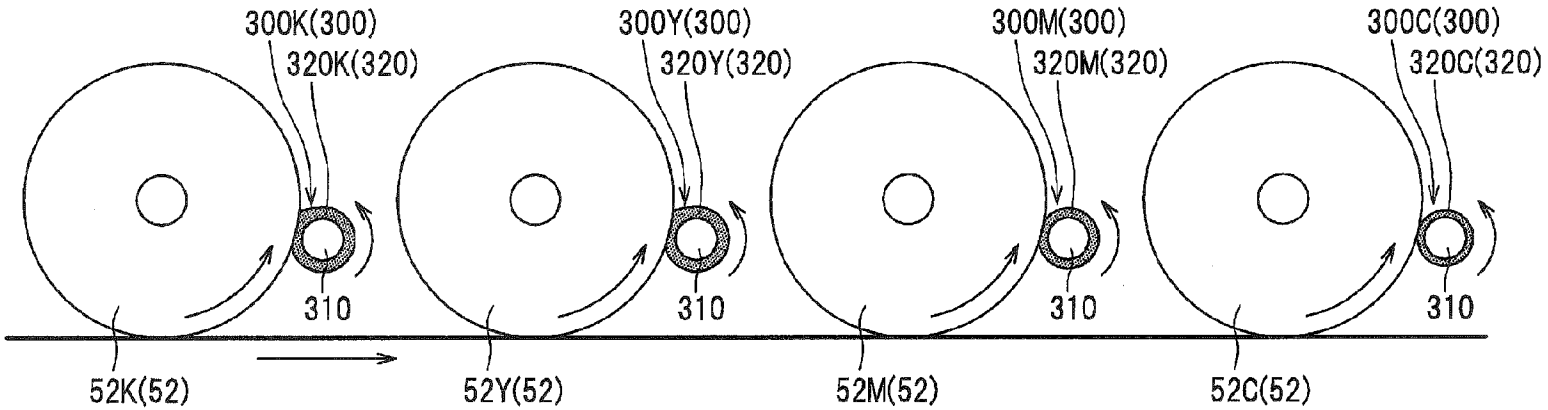
FIG. 4 is a view illustrating a second modification and corresponding to FIG. 2.

FIG. 4 illustrates another example of the configuration in which the cleaning rollers are rotated at the same speed, and the roller portions are formed of the same material. In FIG. 4, roller portions 320 have different thicknesses.

In this configuration, each of cleaning rollers 300 is constituted by a roller shaft 310 and the roller portion 320, and the roller shafts 310 have the same construction. Also, distances between axes of the photoconductive drums 52 and axes of the respective roller shafts 310 are also coincide with each other.

The first roller portion 320K and the third roller portion 320Y have the largest thickness (the same thickness) among the roller portions 320, with the fourth roller portion 320M and the second roller portion 320C following in that order. In this configuration, the first roller portion 320K and the third roller portion 320Y have the largest amount of compression among the roller portions 320 when each pressed by the corresponding roller shaft 310 and the photoconductive drum 52, with the fourth roller portion 320M and the second roller portion 320C following in that order.

In this configuration, the first cleaning roller 300K and the third cleaning roller 300Y have the largest contact pressure among the cleaning rollers 300, with the fourth cleaning roller 300M and the second cleaning roller 300C following in that order.

Figure 5:
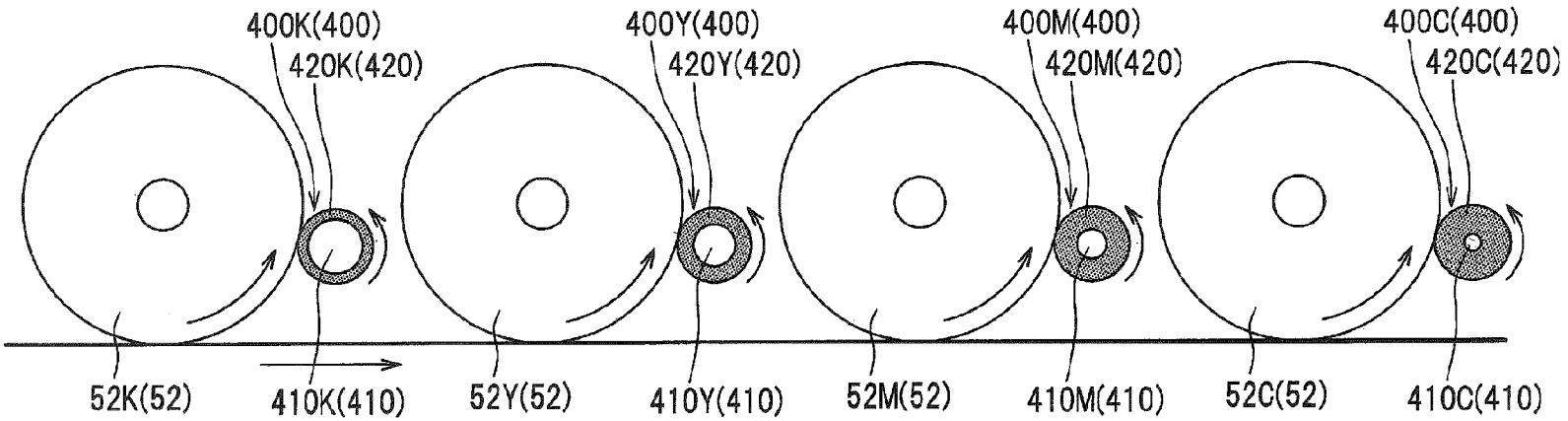
FIG. 5 is a view illustrating a third modification and corresponding to FIG. 2.

As another example different from those illustrated in FIGS. 3 and 4, FIG. 5 illustrates a configuration in which roller portions 420 formed of foam rubber have different thicknesses.

In this configuration, each of cleaning rollers 400 is constituted by a roller shaft 410 and the roller portion 420. The roller shaft 410K has the largest diameter among the roller shafts 410, with the roller shafts 410Y, 410M, 410C following in that order. A roller portion 420K has the smallest thickness among the roller portions 420, with the roller portions 420Y, 420M, 420C following in that order. The cleaning rollers 400 have the same outside diameter.

Increase in the thickness of the roller portion 420 decreases elastic coefficient. Accordingly, in a case where the cleaning rollers 400 are respectively held in contact with the photoconductive drums 52 by the same amount of compression, the first roller portion 420K presses the corresponding photoconductive drum 52 back by the largest force among the cleaning rollers 400, with the third roller portion 420Y, the fourth roller portion 420M, and the second roller portion 420C following in that order. Also, the first roller shaft 410K has the largest diameter and its outer circumferential surface is spaced apart from the corresponding photoconductive drum 52 at the smallest distance among the roller shafts 410, with the third roller shaft 410Y, the fourth roller shaft 410M, and the second roller shaft 410C following in that order. Thus, the force of the first cleaning roller 400K rubbing the corresponding photoconductive drum 52 is affected by the corresponding roller shaft 410 by the largest amount among the cleaning rollers 400, with the third cleaning roller 400Y, the fourth cleaning roller 400M, and the second cleaning roller 400C following in that order. Accordingly, the first cleaning roller 400K is set to have the largest contact pressure among the cleaning rollers 400, with the third cleaning roller 400Y, the fourth cleaning roller 400M, and the second cleaning roller 400C following in that order.

Figure 6:
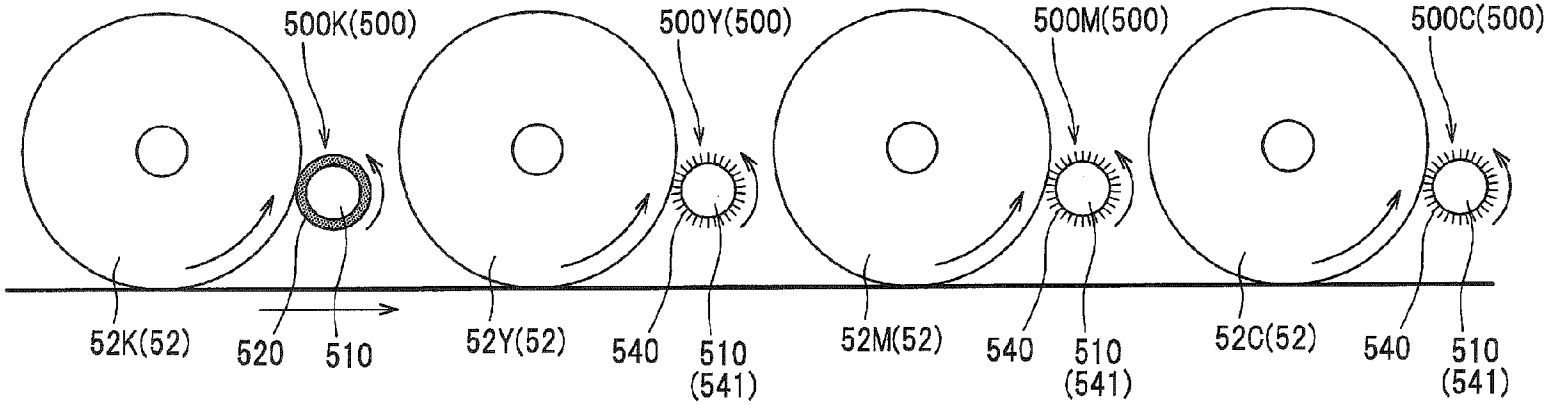
FIG. 6 is a view illustrating a fourth modification and corresponding to FIG. 2.

The surface of the second cleaning roller 100C is formed of the foam rubber in the above-described embodiment, but the present invention is not limited to this configuration. For example, the second cleaning roller 100C may be constituted by a brush roller as illustrated in FIG. 6. It is noted that cleaning rollers 500 are set to be rotated at the same speed.

In this configuration, the first cleaning roller 500K is constituted by a roller shaft 510 and a roller portion 520 formed of foam rubber.

Each of the second cleaning rollers 500Y, 500M, 500C is a brush roller constituted by the roller shaft 510 and a brush layer 541 with a plurality of fibers 540 held on an outer circumferential surface of the roller shaft 510. In this configuration, each of the second cleaning rollers 500Y, 500M, 500C can remove foreign matters, e.g., paper dust from the surface of the second photoconductive drum 52C such that the fibers 540 stroke the surface of the second photoconductive drum 52C.

Here, each of the second cleaning rollers 500Y, 500M, 500C constituted by the brush rollers is smaller than the first cleaning roller 500K formed of the foam rubber in force for rubbing the corresponding photoconductive drum 52, and consequently a smaller load is applied to the photoconductive drum 52 by each of the second cleaning rollers 500Y, 500M, 500C, whereby the second photoconductive drum 52C can be rotated smoothly. Also, the brush roller is less expansive than the roller formed of the foam rubber, resulting in reduced cost.

Figure 7:
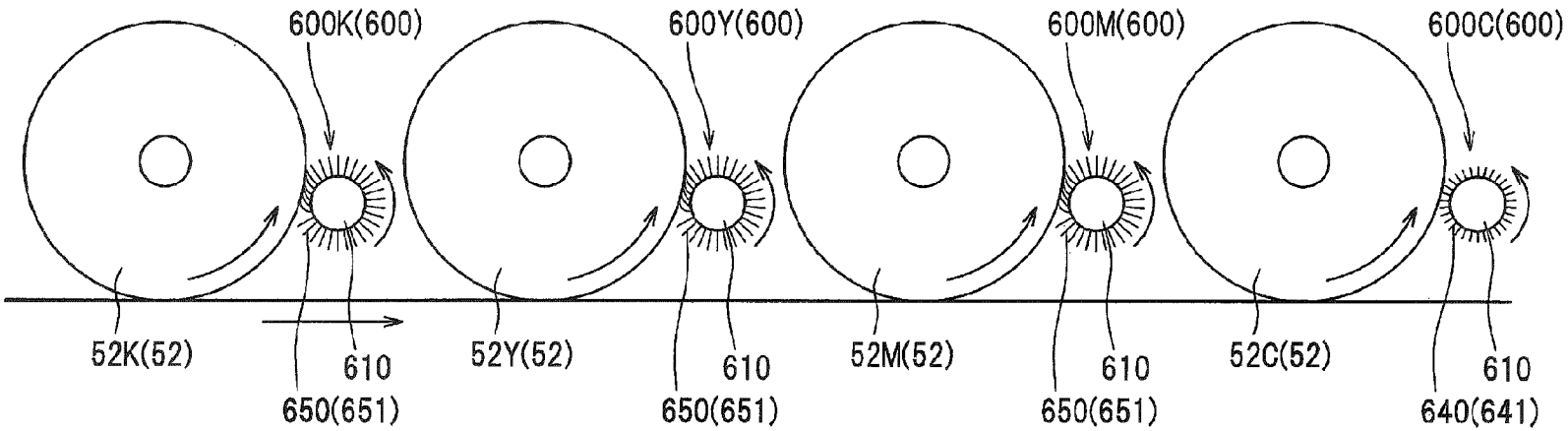
FIG. 7 is a view illustrating a fifth modification and corresponding to FIG. 2.

Only the first cleaning roller 500K has the foam rubber in FIG. 6, but the present invention is not limited to this configuration. For example, as illustrated in FIG. 7, all cleaning rollers 600K-600C may be constituted by brush rollers. It is noted that the cleaning rollers 600 are set to be rotated at the same speed.

In this configuration, each of the first cleaning rollers 600K, 600Y, 600M is constituted by a roller shaft 610 and a brush layer 651 with a plurality of fibers 650 held on an outer circumferential surface of the roller shaft 610, and the second cleaning roller 600C is constituted by a roller shaft 610 and a brush layer 641 with a plurality of fibers 640 held on an outer circumferential surface of the roller shaft 610. Each fiber 650 of the first cleaning rollers 600K, 600Y, 600M is longer than each fiber 640 of the second cleaning roller 600C, so that the area of contact of each fiber 640 with the second cleaning roller 600C is smaller than the area of contact of each fiber 650 with the corresponding one of the first cleaning rollers 600K, 600Y, 600M. Accordingly, the force of the second cleaning roller 600C rubbing the corresponding photoconductive drum 52 is smaller than the force of each of the first cleaning rollers 600K, 600Y, 600M rubbing the corresponding photoconductive drum 52.

In the embodiment, the thickness of the fiber may be changed to make the force of each cleaning roller rubbing the corresponding photoconductive drum 52 different from each other.

In the above-described embodiment, the photoconductive drum 52 is used as one example of the image bearing member, but the present invention is not limited to this configuration. For example, a photoconductor belt may be used as the image bearing member.

While the present invention is applied to the color printer 1 in the above-described embodiment, the present invention may be applied to other image forming apparatuses such as a copying machine and a multifunction peripheral.

While the sheet S such as a thick paper sheet, a postcard, and a thin paper sheet is used as the recording sheet in the above-described embodiment, other types of sheets such as an OHP sheet may be used as the recording sheet.

What is claimed is:

1. An image forming apparatus, comprising:

a first image forming unit comprising a first image bearing member, a first cleaning roller comprising a first roller shaft and a first rotating member configured to rotate about the first roller shaft and configured to rub a surface of the first image bearing member, and a first urging spring configured to directly urge the first roller shaft of the first cleaning roller in a direction directed from the first roller shaft toward the first image bearing member;

a second image forming unit comprising a second image bearing member, a second cleaning roller comprising a second roller shaft and a second rotating member configured to rotate about the second roller shaft and configured to rub a surface of the second image bearing member, and a second urging spring configured to directly urge the second roller shaft of the second cleaning roller in a direction directed from the second roller shaft toward the second image bearing member; and a transfer unit configured to transfer a developer on the first image bearing member and the second image bearing member onto a recording sheet, wherein the first image forming unit is disposed upstream of the second image forming unit in a direction in which the recording sheet is conveyed, and wherein a contact pressure, caused by an urged force of the second roller shaft of the second cleaning roller, at which the second rotating member is in contact with the second image bearing member is less than a contact pressure caused by an urged force of the first roller shaft of the first cleaning roller, at which the first rotating member is in contact with the first image bearing member.

2. The image forming apparatus according to claim 1, wherein a difference in rotational speed between the second rotating member and the second image bearing member is less than a difference in rotational speed between the first rotating member and the first image bearing member.

3. The image forming apparatus according to claim 1, wherein a surface of the first rotating member and a surface of the second rotating member are formed of foam rubber.

4. The image forming apparatus according to claim 3, wherein a hardness of the second rotating member is less than that of the first rotating member.

5. The image forming apparatus according to claim 4, wherein the surface of the first rotating member is formed of ethylene propylene rubber, and wherein the surface of the second rotating member is formed of silicon rubber.

6. The image forming apparatus according to claim 1, wherein the second rotating member is a brush roller.

7. The image forming apparatus according to claim 1, further comprising a third image forming unit and a fourth image forming unit between the first image forming unit and the second image forming unit, wherein the third image forming unit comprises a third image bearing member, a third cleaning roller comprising a third roller shaft and a third rotating member configured to rotate about the third roller shaft and configured to rub a surface of the third image bearing member, and a third urging spring configured to directly urge the third roller shaft of the third cleaning roller in a direction directed from the third roller shaft toward the third image bearing member, and the third image forming unit is disposed upstream of the fourth image forming unit in the conveying direction, and wherein a contact pressure, caused by an urged force of the third roller shaft of the third cleaning roller, at which the third rotating member is in contact with the third image bearing member is equal to the contact pressure at which the first rotating member is in contact with the first image bearing member.

* * * * *